US007059238B2

(12) United States Patent
Albright et al.

(10) Patent No.: US 7,059,238 B2
(45) Date of Patent: Jun. 13, 2006

(54) METHOD AND APPARATUS FOR STROKE POSITION SENSOR FOR HYDRAULIC CYLINDER

(75) Inventors: Larry E. Albright, Gwinner, ND (US); Mark F. Bares, Oakes, ND (US); William C. Shelbourn, Bismarck, ND (US); Scott R. Mason, Mandan, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/957,460

(22) Filed: Oct. 1, 2004

(65) Prior Publication Data

US 2005/0081710 A1 Apr. 21, 2005

Related U.S. Application Data

(60) Provisional application No. 60/512,583, filed on Oct. 17, 2003.

(51) Int. Cl.
*F01B 31/12* (2006.01)

(52) U.S. Cl. ..... 92/5 R

(58) Field of Classification Search ..... 91/1; 92/5 R

See application file for complete search history.

(56) References Cited

U.S. PATENT DOCUMENTS

| | | | | |
|---|---|---|---|---|
| 3,086,414 | A | 4/1963 | Nardi | 81/90 |
| 3,168,853 | A | 2/1965 | Prince | 91/167 |
| 3,403,365 | A | 9/1968 | Richards | 336/30 |
| 3,898,555 | A | 8/1975 | Tellerman | 324/34 D |
| 4,096,621 | A | 6/1978 | Berger et al. | 29/526 R |
| D274,881 | S | 7/1984 | Wilsey | D8/29 |
| 4,523,514 | A | 6/1985 | Burk | 92/5 R |
| 4,552,055 | A | 11/1985 | Foxwell | 92/5 R |
| 4,632,018 | A | 12/1986 | Lymburner | 92/5 R |
| 4,718,647 | A | 1/1988 | Ludwig | 267/64.11 |
| 4,771,866 | A | 9/1988 | Heideman et al. | 188/1.11 |
| 4,788,489 | A | 11/1988 | Kobayashi et al. | 324/61 P |
| 4,952,873 | A | 8/1990 | Tellerman | 324/207.13 |
| 4,961,055 | A | 10/1990 | Habib et al. | 324/662 |

(Continued)

FOREIGN PATENT DOCUMENTS

| | | |
|---|---|---|
| DE | 23 13 215 | 12/1972 |

(Continued)

*Primary Examiner*—F. Daniel Lopez
(74) *Attorney, Agent, or Firm*—Nickolas E. Westman; Westman, Champlin & Kelly, P.A.

(57) ABSTRACT

A fluid pressure cylinder assembly is provided with a sensor for sensing the extension of a piston rod from a tubular cylinder. The tubular cylinder has a base block that seals the end of the tubular cylinder with an inner wall. The inner wall has a threaded bore for receiving the sensor housing, which has an elongated sensor rod passing into an axial bore in the piston rod. The piston rod carries a sensor element that moves relative to the elongated sensor rod. The inner wall is at an inner end of an access bore in the base block. The sensor is threaded into a bore in the inner wall using a socket that has a slot to permit a sensor lead to extend to the exterior of the socket and out of the access bore so the lead rotates with the socket in the access bore while the sensor is tightened in place. The base block is provided with a slot that extends to the exterior of the base block so that when installed the sensor lead can be extended out through the slot for connection to suitable controls.

14 Claims, 3 Drawing Sheets

U.S. PATENT DOCUMENTS

| | | | | |
|---|---|---|---|---|
| 5,150,049 | A | 9/1992 | Schuetz | 324/207.12 |
| 5,182,980 | A | 2/1993 | Greer | 92/5 R |
| 5,198,761 | A | 3/1993 | Hashimoto et al. | 324/207.12 |
| 5,320,325 | A | 6/1994 | Young et al. | 251/1.3 |
| D355,343 | S | 2/1995 | Gliddings, Jr. | D8/29 |
| 5,477,771 | A * | 12/1995 | Black | 92/5 R |
| 5,514,961 | A | 5/1996 | Stoll et al. | 324/207.13 |
| 5,583,433 | A | 12/1996 | Sawa | 324/207.13 |
| 5,717,330 | A | 2/1998 | Moreau et al. | 324/207.13 |
| 5,952,823 | A | 9/1999 | Nyce et al. | 324/207.13 |
| 5,977,778 | A | 11/1999 | Chan et al. | 324/635 |
| 5,998,992 | A | 12/1999 | Arai | 324/207.13 |
| 6,058,813 | A | 5/2000 | Bryant et al. | |
| 6,122,997 | A | 9/2000 | Altura | |
| 6,509,733 | B1 | 1/2003 | Blubaugh et al. | |

FOREIGN PATENT DOCUMENTS

| | | |
|---|---|---|
| DE | 91 09 026 | 9/1991 |
| DE | 100 44 984 A1 | 3/2002 |
| EP | 1 070 856 A1 | 1/2001 |
| GB | 1 601 572 | 10/1981 |

* cited by examiner

METHOD AND APPARATUS FOR STROKE POSITION SENSOR FOR HYDRAULIC CYLINDER

This application claims the benefit of and priority on U.S. Provisional Application Ser. No. 60/512,583, filed Oct. 17, 2003, the contents of which is incorporated by reference.

BACKGROUND OF THE INVENTION

The present invention relates to a sensor that is used for sensing and indication of the stroke position of a hydraulic cylinder, that is, indicating the amount of extension or the position of the rod of a hydraulic cylinder from a reference. The sensor is made so it can be installed and removed without disassembly of the cylinder. The sensor installs in the base end of the cylinder tube and can be tightened in place and removed with a sensor connection wire attached to the sensor.

It is desirable to have stroke or position sensing and indicating capabilities in a hydraulic cylinder used for various applications, such as on skid steer loaders, to provide information as to the position of lift arms of a loader or the position of various parts on attachments that are moved by hydraulic actuators. In particular, position sensors can be used, for example, where the fluid pressure cylinder extends a loader lift arm. Another use is for cylinders that are part of a steering system. Installation and removal of existing sensors for service and even for initial assembly has been a problem, and generally requires multiple parts and difficult positioning and potential for damage.

For example, U.S. Pat. No. 6,509,733 shows a fluid cylinder that has an internal stroke sensor, and the sensor itself is not accessible from the exterior of the cylinder when the cylinder is assembled.

U.S. Pat. No. 6,509,733 shows a type of sensor that could be installed or mounted as disclosed herein, and other types of sensors usable for sensing stroke or position include magnetostrictive linear displacement devices, sensors that have transmitters and receivers, and LVDT sensors.

The present invention is directed to providing a construction and method of installing a sensor into a base end of a fluid cylinder after the cylinder is otherwise assembled with a piston and piston rod, and which can be removed without substantial disassembly of the cylinder.

SUMMARY OF THE INVENTION

The present invention relates to a position sensor assembly for a fluid pressure cylinder assembly that has an internal piston and a rod which is extendable and retractable under fluid pressure on opposite sides of the piston. The sensor assembly can be installed after the cylinder has been otherwise completely assembled, and the sensor assembly can also be removed without disassembling the cylinder, that is removing the piston and piston rod. An accessible threaded port or bore in the base of the cylinder receives a sensor assembly housing that has an elongated element that extends into the interior of the cylinder and into an interior passageway in the piston rod. The leads or wires from the sensor can be left in place as the sensor is secured by threading the sensor into the base end bore. The wires or leads for the sensor are extended laterally through a slot in a side wall of the wrench socket used for tightening the sensor threads, the sensor leads are positioned so they can rotate with the sensor as the sensor is tightened, without wrapping up on the sensor or wrench. When the wrench socket is removed, the leads are slipped into an open ended slot in the side of the cylinder base for connection to the read out circuitry.

The sensor is protected from the environment since it is mounted inside a longitudinal bore in the base of the cylinder. The sensor lead (usually one lead with multiple wires in it) is connected to remote circuitry so the sensor signal that indicates positions of the piston and rod can be used for controlling the linear axial position of the piston rod. The signal can be used to control various functions dependent on the piston rod position.

The installation of the sensor requires no special tools, but does utilize a wrench socket that has a slit that permits the sensor wire or lead to be passed to the outside of the socket. During the rotation needed to threadably tighten the sensor in place in the cylinder, the lead is extended out of a longitudinal center bore in the cylinder base. The sensor assembly does not have to be installed until all operations for making and assembling the cylinder assembly are completed. The sensor assembly then is slid through the longitudinal bore in the cylinder base and the elongated sensor element is slid through the bore in the end wall and into a bore in the piston rod.

Service of the sensor assembly after use of the cylinder is also easily done. When the piston is retracted, the sensor assembly can be removed and replaced with little or no loss of hydraulic fluid without removing the hydraulic hoses leading to the valve controlling the cylinder.

DETAILED DESCRIPTION OF THE PREFERRED EMBODIMENTS

Figure 1:
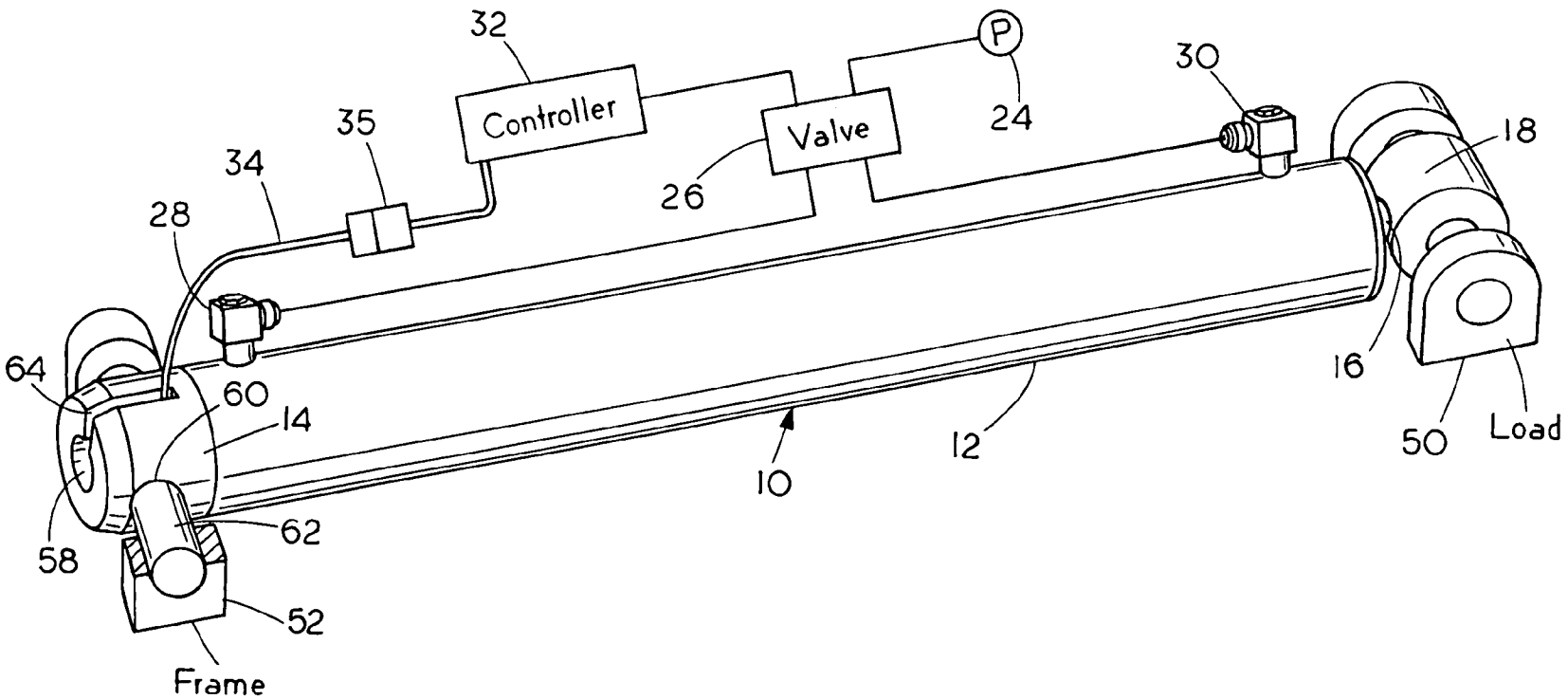
FIG. 1 is a perspective view of a typical fluid pressure cylinder assembly utilizing a stroke or rod position sensor arrangement made according to the present invention.

In FIG. 1, a fluid pressure cylinder assembly indicated at 10, such as a hydraulic or pneumatic cylinder or actuator, is provided with an outer cylinder tube 12. A cylinder base block 14 closes one end of cylinder tube 12, and an extendable and retractable piston rod 16 having a rod end 18 extends through a rod end cap at the other end of the cylinder to the outside of the cylinder tube 12.

Figure 2:
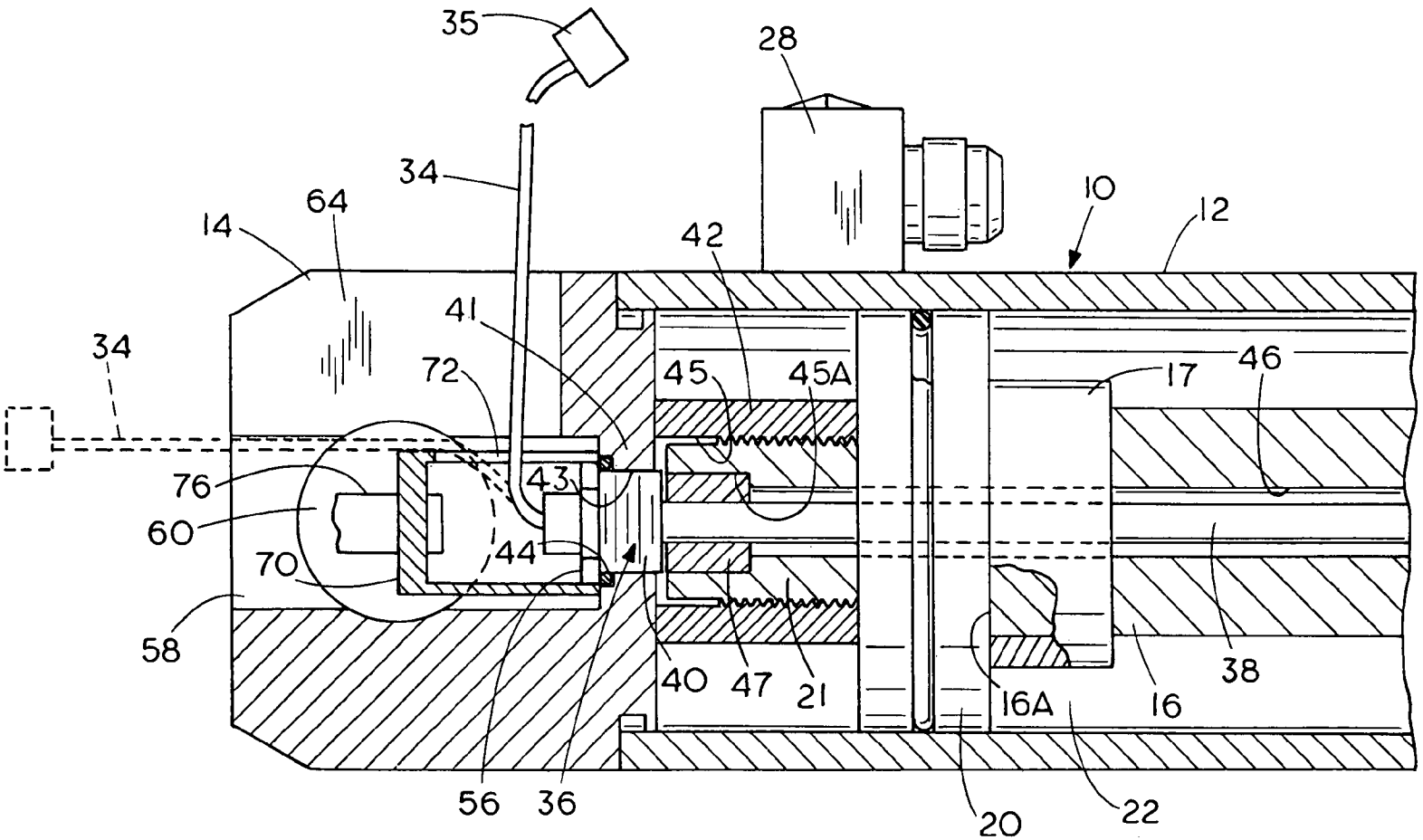
FIG. 2 is a sectional view of a base end of the cylinder assembly with a sensor installed, and a wrench socket in position for such installation.
Figure 3:
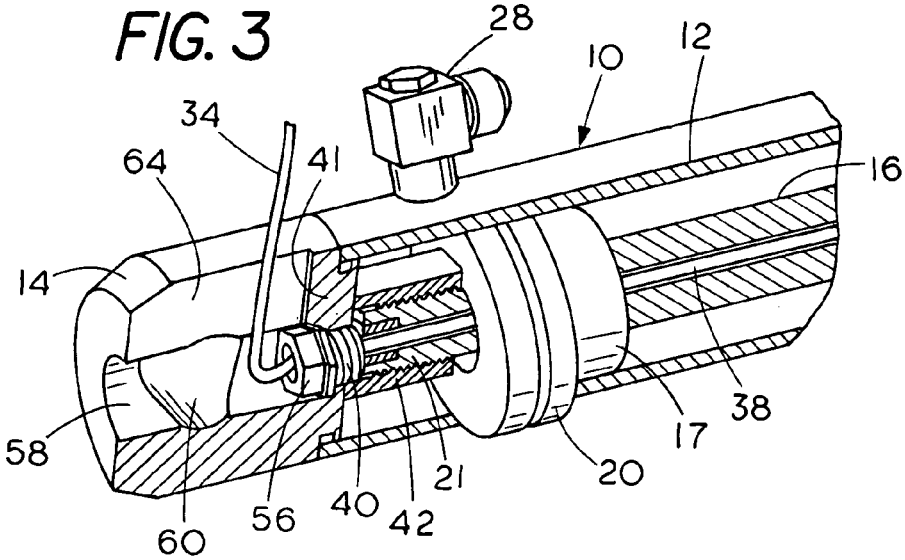
FIG. 3 is a fragmentary perspective view of the base of the cylinder assembly showing the sensor installed, and with parts in section and parts broken away.
Figure 4:
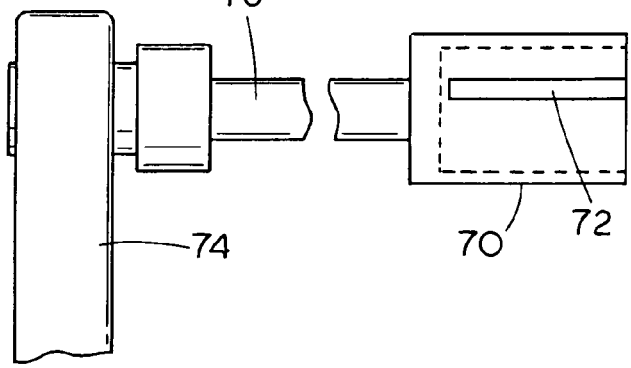
FIG. 4 is a side view of a wrench socket as utilized with the present invention and showing a slit for extension of the sensor lead from the socket during the tightening or loosening operation.

Referring to FIG. 2, it can be seen that the piston rod 16 is connected to a piston 20 that is mounted on the interior chamber 22 of the cylinder tube 12. The piston rod 16 has a reduced diameter neck 21 that passes through a bore in piston 20. A shoulder 16A is formed on piston rod 16 that bears against and supports the piston. A spacer 17 is shown in place over the rod 16 and against the piston, and is broken away to show the shoulder 16A.

The piston 20 is held on a threaded end of neck 21 of the rod 16 with a nut 42. The nut 42 has an interior bore 45 that is unthreaded at a portion adjacent the outer end of the bore. The end of nut 42 extends outwardly beyond the end of the piston rod neck. The nut 42 is tightened securely to hold the piston 20 in place. The end of the nut 42 will abut on the inner surface of the base block when the piston and piston rod are retracted.

The piston 20 is movable under differential pressure and the rod 16 is thus extendable and retractable under fluid pressure. As shown, a pump or pressure source 24 is connected through a valve 26 to direct fluid under pressure to or from a base end fitting 28, and a rod ending fitting 30 for extension and retraction of the piston rod 16. A controller 32 is shown for controlling the position or extension of the rod end 18, and the controller receives a feedback signal for determining the extension of the piston rod 16 and the rod end 18 along a lead or line 34 that leads from a piston stroke position sensor assembly 36 shown in FIG. 2.

The sensor assembly 36 includes an elongated first transducer element or rod 38, mounted at a sensor base or housing 40. The piston rod 16 has a longitudinal bore 46 that receives the transducer element or rod 38, which can be slid longitudinally into the bore 46. The bore 46 extends through the neck 21. The transducer element or rod 38 extends from the base end of the piston rod 16, through neck 21 for the majority of the length of the piston rod 16.

As can be seen, the base block 14 of the cylinder assembly 10 is a block that has a base or inner wall 41 that forms the base end of the chamber or bore 22 of the cylinder tube 12. The end wall 41 closes the end of the cylinder tube 12. The nut 42 that threads onto neck 21 has an outer end surface that abuts on base wall 41 to form a stop for the piston 20 when the piston is retracted.

The inner or base wall 41 of the base 14 has a center threaded bore 43 that receives and forms a support for the sensor housing 40 in the end wall 41 of the base 14. The bore 43 is threaded to hold the sensor assembly 36, including the elongated transducer rod 38. The sensor housing can be sealed relative to the wall 41 with an "O" ring 44 around its periphery. The elongated transducer rod 38 and the sensor housing 40 are removable as a unit from the interior bore 46 in the piston rod 16.

The sensor assembly 36 can be any desired sensing unit that can be activated and energized, and which will provide signals that indicate the position of the piston and piston rod that are transmitted along the lead line 34. Lead line 34 can contain more than one wire, as desired, but will carry signals to excite the sensor, if desired, and also will provide feedback signals indicating the position of the piston rod (and piston) relative to a reference position, as shown, the base where the piston and piston rod are in a retracted position shown in FIG. 2. The end of the bore 46 in the neck 21 of the piston rod that faces the base block 14 has a counter bore 45A that mounts a second transducer element 47 that as shown is in the form of a ring that moves (slides) along first transducer element or rod 38 with the piston 20 and piston rod 16. This second element 47 cooperates with the first element 38 to provide a signal at the sensor housing, which indicates the position of the second element 47 along transducer element or rod 38 and thus the extension position of the piston rod 16 and piston rod end 18. The second sensor element can be a contact that slides on the rod 38, if a variable resistance sensor is used. The electronic circuitry for the sensor is provided at controller 32.

Rod end 18 is connected to a load or movable member represented schematically at 50, and the cylinder block base 14 is connected to a frame support 52. Thus, the distance of movement or position of the load or work member 50 can be determined by the signal indicating the position of movable second transducer element 47 relative to the stationary transducer rod 38.

Figure 5:
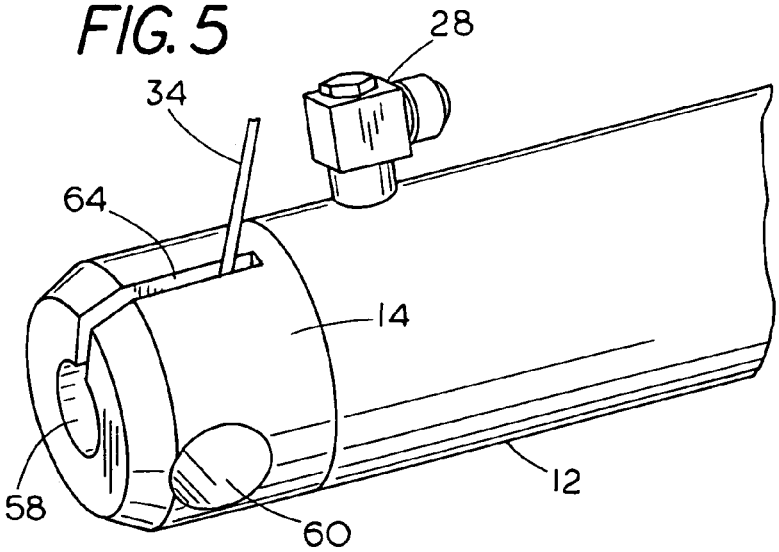
FIG. 5 is a partial perspective view of the exterior of a base end of the cylinder assembly with a sensor lead wire shown.

Sensor housing 40 is installed in bore 44 using a unique method. The outer end of the sensor housing 40 has a hexagon configuration or hex nut 56, and the lead 34 (which can have several wires in it) extends from the center of the sensor housing 40. The cylinder base 14 has an axial access bore 58 open at the base end, and extending to the end wall 41. The base 14 also has a cross bore 60 that is used for mounting a pin 62 (FIG. 1) for in turn mounting the base 14 to the frame support 52. Additionally, the base 14 has a radial slot or slit 64 formed therein that joins the axially bore 58, and extends radially out to one lateral side, for example, the side that contains the base end hydraulic line fitting 28 as shown in FIG. 5. The slot or slit 64 has a longitudinal length opening along the side of access bore 58 and intersecting the bore 58.

For installation and removal of the sensor, a wrench socket 70 that has a longitudinally extending slot 72 therein is utilized, and it is attached to a suitable socket drive 74 in a conventional manner. The socket drive 74 has an extension shank 76 that is provided on the drive 74, and which has a drive end that drives the socket 70.

The inner diameter of the access bore 58 in the base 14 is large enough relative to the outer surface of the socket so that the wrench socket 70 will slide into the bore 58 with some clearance around the outer periphery and fit over the end of housing 40. When installing the sensor assembly 36, the wrench socket 70 is slipped onto the hex outer configuration or nut end 56, and the sensor lead 34 is placed through the slot 72 of the socket, so that the lead 34 extends out of the socket 70. Then the lead 34 is extended longitudinally along or axially along the inner surface of the access bore 58 and to the outside of the drive end of the socket as shown in dotted lines in FIG. 2.

A suitable connector 35 is used at the end of the lead 34, and the lead would not be of excessive length. However, it can be seen that the lead 34 will rotate with the wrench socket and sensor housing 40 inside the access bore 58 as the sensor assembly 36 is tightened in place. A suitable "O" ring 44 rests against a flange to seal the threaded bore 43, so that the interior of the cylinder tube 12 is sealed or closed.

When the sensor assembly 36 is tightened in place with the first transducer rod or element 38 extending into the central bore 46 of the piston rod 16, the wrench socket 70 is removed, and the lead 34 is released from the slot 72 of the socket. The lead 34 then can be passed through the slot 64 from bore 58, and connector 35 can be mated with a connection to the controller 32. The lead or wire 34 is placed to the interior side of the cross bore 60 and thus between pin 62 and the sensor housing and so the lead 34 is not moved or stretched excessively if the cylinder assembly 10 pivots on the pin 62. The lead is also protected by the pin 62 when the pin 62 is in place.

The sensor assembly 36 can be installed after all operations for manufacturing the cylinder assembly 10 are done. That insures that the sensor elements will not get physically damaged or affected by welding, heat treating, painting and the like, which are necessary for manufacturing the cylinder assembly.

The removal of the sensor assembly 36 is an opposite procedure, namely the wrench socket 70 would be put into position on the hex end of the sensor housing after the pin 62 has been removed. The connector 35 would be separated and the lead 34 would be extended into the slot 72 (which is an axially extending slot) of the wrench socket 70. The socket would be placed over the drive end or hex end 56 of the sensor housing 40. The lead 34 would be removed from slot or slit 64 and extended out the end of access bore 58 so it could be rotated without twisting. Then the socket would be driven to rotate and unthread the sensor housing 40. At the same time the lead 34 would be rotating so that it would not be wound up on the wrench socket or damaged by extending out the end of the socket that is on the hex end 56. The sensor housing 40 and transducer rod 38 would be removed axially after threading the sensor housing out of the bore 43 in which it is mounted in the base 14.

The sensor assembly 36, including transducer rod 38, is pulled out of the cylinder base block and serviced or replaced. When the sensor assembly 36 is again put into the cylinder, the wrench socket 70 again would be put into position on the end of the sensor housing 40 with the sensor lead extending through the slot 72. The socket, sensor and the lead would be rotated as a unit to tighten the sensor housing in place. The socket would be removed with the lead 34 sliding out the end of the slot 72, and placed through the slot 64 in the base 14 to be connected to a controller or similar item.

It should be noted that many types of sensors can be accommodated with the mounting in the base of the cylinder using the axially centered threaded bore in the base end. A magnetostrictive linear displacement sensor is shown. The second element 47 is a ring magnet with this type of sensor. Any type of threaded sensor housing that can be threaded into place according to the present invention using a slotted socket can be used. The electronics package is not included, but is part of the controller remote from the cylinder. Variable resistor sensors can also be used where a contact on the piston or piston rod slides along an elongated transducer element.

The sensor, again, is protected by the base block since it is in a recess, but is accessible from the exterior through the axial clearance access bore 58 pin 62 is removed.

It also can be seen that the end of the nut 42 that threads into piston rod 16 abuts on the inner end of the base block 14 when the piston is retracted. This helps to isolate the sensor from the hydraulic oil. Then, with the hydraulic pressure relieved on the base side of the piston, very little oil leakage past the abutting parts will occur if the sensor is removed for service.

Although the present invention has been described with reference to preferred embodiments, workers skilled in the art will recognize that changes may be made in form and detail without departing from the spirit and scope of the invention.

What is claimed is:

1. In a fluid pressure cylinder assembly having a piston mounted on the interior of a tubular cylinder and an extendable and retractable rod connected to the piston, the improvement comprising a mounting arrangement for a sensor housing securable in a bore on a base end of the tubular cylinder, the mounting arrangement comprising a cylindrical outer wall base on the tubular cylinder, the base having an inner end wall with a first bore along a central axis of the cylindrical outer wall and open to an interior of the tubular cylinder, the first bore having an outer end portion for receiving and securing a sensor housing, and a second axially extending bore in the base of the tubular cylinder that is coaxial with the first bore and that has a size greater than the first bore and which extends from the outer end of the first bore to an outer end of the base, said second bore being of size to receive a tool movable to secure a sensor housing in the first bore, the base having a cross bore to receive a mounting pin with the cross bore intersecting the second bore, and a slot in the base opening from the second bore to an exterior of the base, said slot being of size to receive a lead from a sensor and extending inwardly from an outer end of the base farther than the cross bore, and a wall of the second bore being substantially continuous except for the cross bore and slot.

2. In a fluid pressure cylinder assembly having a piston mounted on the interior of a tubular cylinder and an extendable and retractable rod connected to the piston, the improvement comprising a sensor having a sensor housing mountable on a base end of the tubular cylinder, a base on the tubular cylinder having an end wall with a first bore open to the tubular cylinder for receiving and threadably securing the sensor housing, and a second axially extending bore in the base of the tubular cylinder that has a size greater than the first bore, said second bore being of size to receive a drive socket rotationally movable to threadably secure the sensor housing in the first bore, a slot in the base opening from the second bore to an exterior of the base, said sensor housing having a drive end, and a sensor lead extending from the drive end, a drive socket for driving the sensor housing for threading, the drive socket having a second slot on a side thereof, the second slot being of size to permit the sensor lead to pass from an interior of the socket to the second bore and the first slot being of size to permit the sensor lead to pass from the second bore to the exterior of the base.

3. The cylinder of claim 2 and a third bore in the base extending laterally across the second bore and spaced outwardly from the end wall having the first bore so that the sensor is inwardly from the third bore, the third bore being of size for mounting a pin, the slot in the base extending inwardly from the third bore so the sensor lead can pass out through the slot in the base with a pin in place in the third bore.

4. In a fluid pressure cylinder assembly having a piston mounted on the interior of a tubular cylinder and an extendable and retractable piston rod connected to the piston, the improvement comprising a sensor mountable on a base of the tubular cylinder, said sensor including a threaded sensor housing, an inner end wall in the base of the tubular cylinder having a first threaded bore for receiving the threaded sensor housing, a rotationally drivable configuration on a drive end of the sensor housing, and a second bore in the base of the tubular cylinder extending from an outer end of the base to the inner end wall, the second bore being of size greater than the first bore to receive a socket that will fit over the drive end of the sensor housing to permit threadably installing the sensor housing from an exterior of an outer end of the second bore and, wherein said sensor housing has a sensor lead extending therefrom, the socket for driving the sensor housing having a slot in a sidewall thereof for permitting the sensor lead to pass from an interior of the socket to the exterior.

5. The cylinder assembly of claim 4, wherein the first and second bores are parallel to a longitudinal axis of the tubular cylinder, and the base of the tubular cylinder has an axially extending slit extending from the second bore to an outer side periphery of the base such that the sensor lead can extend along the second bore while the threaded sensor housing is threadably installed, and the slit in the base being of size to permit the sensor lead to pass through the slit to an exterior of the outer side periphery of the base.

6. The cylinder assembly of claim 5 and a third bore in the base extending laterally across the second bore and spaced outwardly from the first bore so that the sensor is entirely to an inner side of the third bore, the third bore being of size for mounting a pin, the slit in the base extending inwardly beyond the third bore so the sensor lead can pass out through the slit with a pin in place in the third bore.

7. The cylinder assembly of claim 4 further characterized in that the sensor housing is centered on a longitudinal axis of the piston rod and has an elongated sensor rod portion, and a bore in the piston and piston rod aligning with the first threaded bore for receiving the elongated sensor rod portion.

8. The cylinder assembly of claim 7, further characterized by a sensor element mounted to move with the piston and piston rod and movable along the elongated sensor rod portion of the sensor as the piston rod extends and retracts along the tubular cylinder.

9. A method of installing a sensor in a fluid pressure cylinder assembly having a longitudinal axis, the sensor having a threaded housing with a drive end, and an opposite end of the threaded housing supporting a first sensor element, the sensor having a sensor lead extending from the drive end, a base end portion of the cylinder assembly having an access bore open to the exterior that is of size for a socket to fit into the access bore and engage the drive end of the threaded housing to rotationally drive the sensor into a second smaller bore in an interior wall portion of the base end portion of the cylinder assembly, the method comprising providing a socket that fits over the drive end of the threaded housing, providing a longitudinally extending slot in a side wall of the socket, placing the sensor lead through the slot in the socket to extend from an interior of the socket to an exterior of the socket and into the access bore, threadably driving the sensor into the second smaller bore with the socket, and with the sensor lead extending along the access bore and moving rotationally with the socket, removing the socket from the access bore while leaving the sensor lead in the access bore.

10. The method of claim 9 and further providing an axially extending slit in a side wall of the base end portion open from the access bore to an exterior of the base end portion, and passing the sensor lead out of the access bore through the provided axially extending slit in the side wall of the base end portion of the cylinder assembly when the socket is no longer rotationally moved.

11. The method of claim 9 including providing the access bore and smaller bore along a common axis centered on the longitudinal axis of the cylinder assembly.

12. The method of claim 11 including providing a cross bore in the base end portion of the cylinder assembly that extends across the access bore, and which cross bore is spaced from the second smaller bore, forming the provided slit in the base end portion of the cylinder assembly inwardly past the cross bore, and placing the sensor lead through the slit and between the cross bore and the threaded housing.

13. The method of claim 9 including securing the base end portion to a cylinder tube to form the cylinder assembly and assembling a piston and piston rod in the cylinder assembly prior to installing the sensor in the cylinder assembly, and thereafter threadably driving the threaded housing into the smaller bore.

14. The method of claim 9 including providing a pressure seal between the threaded housing and the interior wall.

* * * * *